US005185986A

United States Patent [19]

Connolly et al.

[11] Patent Number: 5,185,986

[45] Date of Patent: Feb. 16, 1993

[54] BAIL APPLICATOR AND METHOD

[75] Inventors: John J. Connolly, Lynbrook; John T. Kawochka, Maspeth, both of N.Y.

[73] Assignee: Pfizer, Inc., New York, N.Y.

[21] Appl. No.: 835,050

[22] Filed: Feb. 11, 1992

Related U.S. Application Data

[63] Continuation of Ser. No. 604,706, Oct. 26, 1990, abandoned.

[51] Int. Cl.[5] ..... B65B 29/04

[52] U.S. Cl. ..... 53/397; 53/413; 53/134.1; 53/314; 53/534; 53/580

[58] Field of Search ..... 53/49, 131, 397, 399, 53/411, 413, 134, 287, 293, 313, 314, 315, 534, 580, 594, 134.1; 29/773, 774, 786, 793

[56] References Cited

U.S. PATENT DOCUMENTS

| | | | |
|---|---|---|---|
| 2,386,797 | 10/1945 | Hohl | 29/773 X |
| 3,382,646 | 5/1968 | Leudtke | 53/314 |
| 3,523,355 | 8/1970 | Schlapkohl | 53/313 X |
| 4,096,620 | 6/1978 | Kontz | 29/773 X |
| 4,098,058 | 7/1978 | Carrigan | 53/315 |
| 4,236,305 | 12/1980 | Hetherington | 29/774 |
| 4,238,256 | 12/1980 | Faust et al. | 156/65 |
| 4,562,688 | 1/1986 | Mueller | 53/399 |
| 4,932,824 | 6/1990 | Goslin | 53/313 |

*Primary Examiner*—John Sipos
*Attorney, Agent, or Firm*—Peter C. Richardson; Lawrence C. Akers; John L. LaPierre

[57] ABSTRACT

An apparatus and method for applying a cap member to a receptacle or container. The apparatus and method are particularly suitable for use in placing the cap member, including a bail, snugly onto the end of a receptacle adapted to contain a pharmaceutical agent.

15 Claims, 4 Drawing Sheets

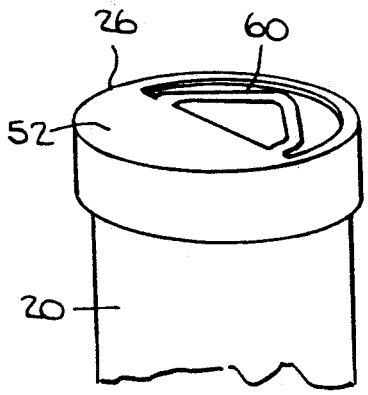
Fig. 5.
Fig. 6.
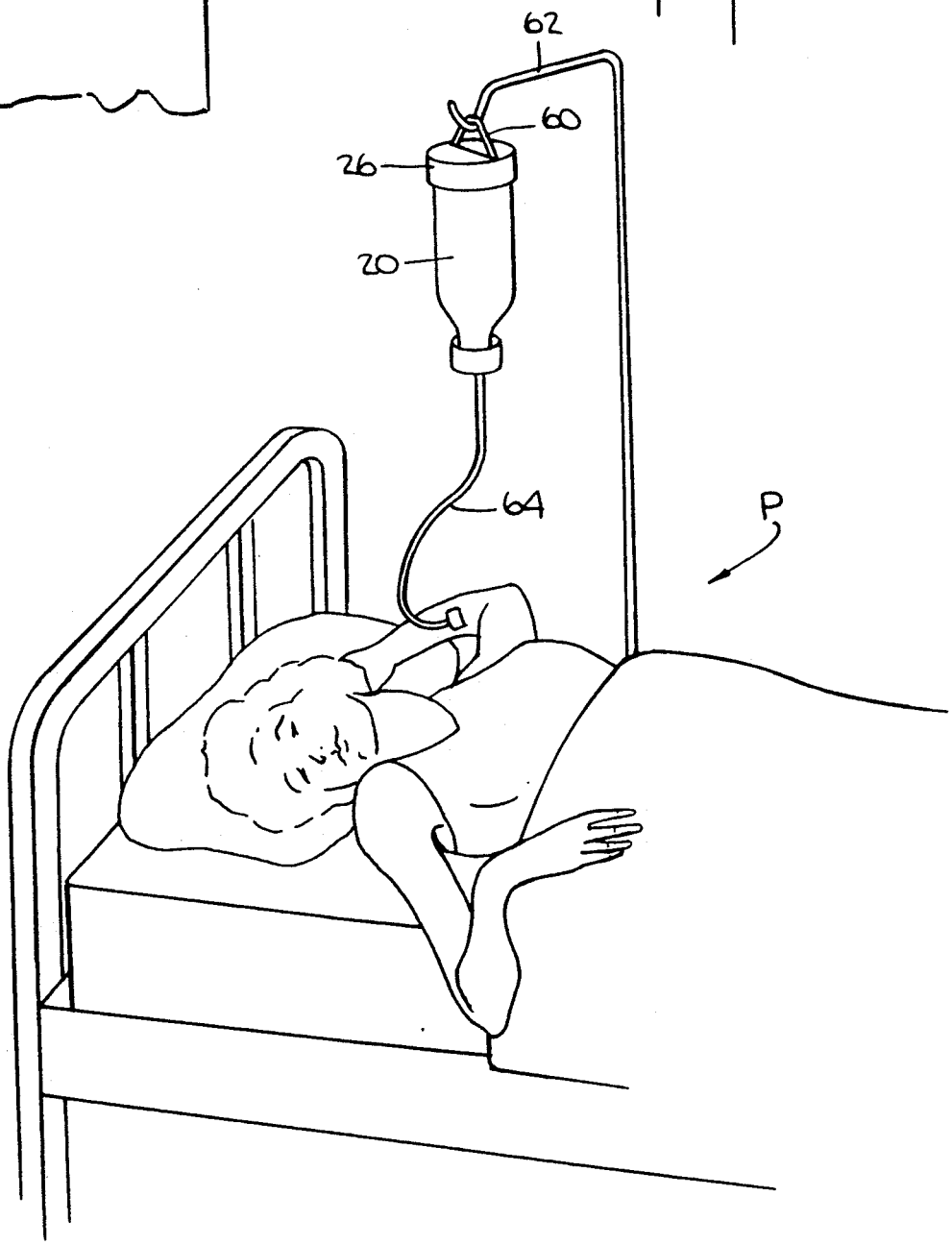

BAIL APPLICATOR AND METHOD

This is a continuation of application Ser. No. 604,706, filed on Oct. 26, 1990, now abandoned.

BACKGROUND OF THE INVENTION

The present invention pertains generally to an apparatus and method for placing a cap on an end of a receptacle or container. More particularly, the invention relates to the apparatus and method for applying a cap member, supporting a bail, to an end of a receptacle of the type widely used in hospitals. The receptacle is particularly suited to contain a pharmaceutical agent, with the receptacle in use being inverted and suspended by the bail during administration of a pharmaceutical product to a patient.

A hospital intravenous (I.V.) bottle is commonly provided with a bail, or hanger, so that the bottle can be suspended upside down during fluid dispensing. The bail must be secured to the base of the bottle. One method previously used for the placement of bail members, commonly made of plastic, on the bottom of I.V. bottles was manual. A person would pick up a bottle individually and force the bottle into a bail supporting cap resting on a table top or other flat surface. This procedure was tedious and time consuming. Consequently, the manual bail placement method was automated using machinery. However, the mechanized method in principle functioned in much the same manner as the manual version, that is, forcing a bottle into a cap supported on a flat surface.

In an effort to overcome the deficiencies of prior bail applying devices and methods, the present apparatus and method was devised. The present inventive device and method is compact and efficient and employs the principle of rotary motion and an inclined surface. A rotating platform or starwheel is used to move a receptacle into contact with a bail supporting cap member located on the inclined surface. The rotary starwheel, having chamfered pockets to apply both lateral and downward force to the receptacle, moves both the receptacle and cap causing the cap to move up the inclined surface and become seated on the receptacle.

SUMMARY OF THE INVENTION

The present invention is directed toward an apparatus for applying an end cap member to a receptacle comprising means for moving the receptacle from a first position to a second position in a first plane, a first surface located intermediate the first and second positions defining a second plane having a first portion spaced from the first plane, with the second plane extending from the first portion toward the first plane generally in the direction of receptacle movement, the cap member being positioned on the surface and with the cap member being configured for receiving an end of the receptacle, and means for moving the receptacle and the cap member, with the receptacle being positioned for receipt within the cap member, along the first surface wherein the cap member and the receptacle are pressed snugly into engagement. The cap member is generally cup-shaped and includes a bottom wall and a side wall having an inner surface with means for engaging complementary means disposed on the receptacle. The cap member supports a bail member. The apparatus further includes means for capturing and for substantially maintaining the receptacle in a predetermined orientation.

The apparatus also includes a second surface which contacts the receptacle for substantially restraining the receptacle against movement in a plane substantially perpendicular to the first plane.

The invention in another aspect embodies a first surface having a first slope, means for advancing a receptacle along the first surface, a second surface having a second slope, with the second surface being stepped down from the first surface at a first location along the first surface and with the second surface sloping upwardly from the first location in the direction traveled by the advancing receptacle, a cap member being positioned on the second surface proximate the first location, with the cap member being configured to receive therein an end of the receptacle, and means for advancing the receptacle, aligned for receipt within the cap member, and the cap member along the second surface wherein the cap member is pressed snugly onto the receptacle. The first surface might have a substantially horizontal slope and the apparatus might include means for maintaining the receptacle substantially vertical. The cap member, being of cup-shaped configuration, might include a flexible bail member formed in a bottom wall thereof. Additionally, the apparatus might include a third surface, being beveled, for contacting a shoulder portion of the receptacle and for substantially restraining the receptacle against movement in a plane substantially perpendicular to the first surface.

Additionally, further embodied within the scope of the invention is a method of applying an end cap member to a receptacle according to the steps of supplying a receptacle at a first location, advancing the receptacle along a pathway to a second location, at the second location, supplying a cap member being configured to receive therein an end of the receptacle and being positioned on a surface extending toward the pathway and sloping in the direction of receptacle advancement, aligning the receptacle and the cap member, positioning the receptacle for receipt within the cap member, and advancing along the surface the aligned receptacle and cap member and pressing the receptacle and the cap member into snug engagement.

BRIEF DESCRIPTION OF THE DRAWINGS

FIG. 5 is an enlarged, partial view illustrating the receptacle, in an inverted position, with the cap member securely attached and further showing a bail formed in the bottom wall of the cap member.

FIG. 6 illustrates the receptacle, with attached cap member and bail, suspended for use during patient administration of a pharmaceutical agent.

DETAILED DESCRIPTION OF THE PREFERRED EMBODIMENTS

Figure 1:
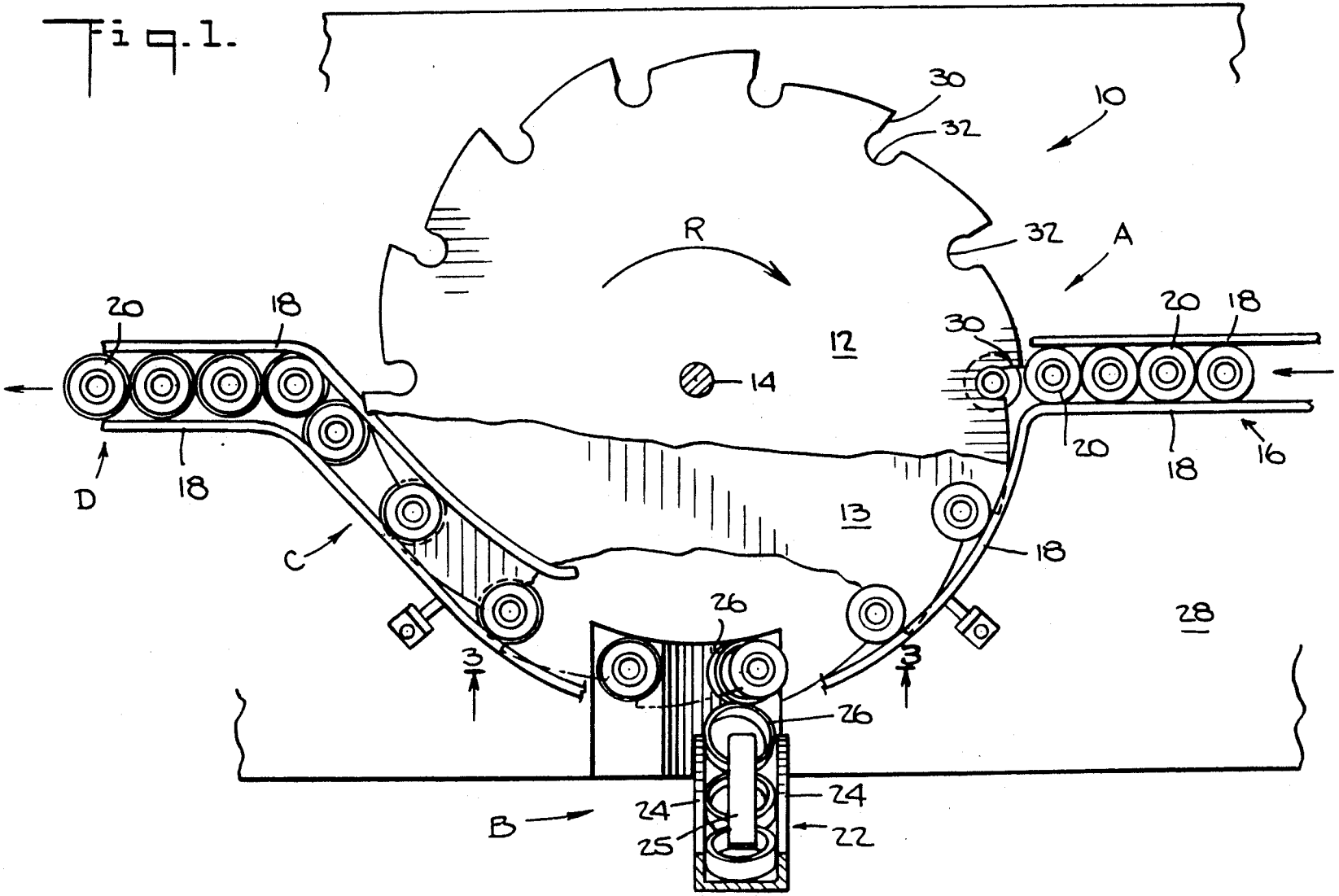
FIG. 1 is a schematic, top plan view, with a cut-away section, of a bail applicator in accordance with the principles of the present invention.

The description herein presented refers to the accompanying drawings in which like reference numerals refer to like parts throughout the several views. Referring to FIG. 1, in accordance with the principles of the present invention, there is illustrated a top plan view schematic of bail applicator 10. Also included in this view are platforms 12 and 13 which rotate about spindle 14 in the direction indicated by arrow R. A motor, not shown, is used to impart motion to the platforms. Further depicted is trackway 16 with rails 18 guiding an inlet supply of receptacles or containers 20. Additionally shown is supply chute 22 having rails 24 and guide finger 25 for directing an inlet feed of end cap members 26. In this view, sequentially, receptacle 20 is fed to inlet location A and advanced toward location B along surface 28, substantially horizontal in this embodiment, by rotating platform 12 having receptacle contacting edge 30 and receptacle receiving pocket 32. Platform 13, in the preferred embodiment, also assists in guiding receptacle 20 as will be better seen in FIGS. 2–4. At location B, end cap member 26 is fed into aligned position beneath receptacle 20 for subsequent placement thereon as the combination receptacle and cap member is advanced toward location C wherein the rotating platforms release the receptacle. Thereafter, the finished product leaves the bail applying apparatus at location D.

Figure 2:
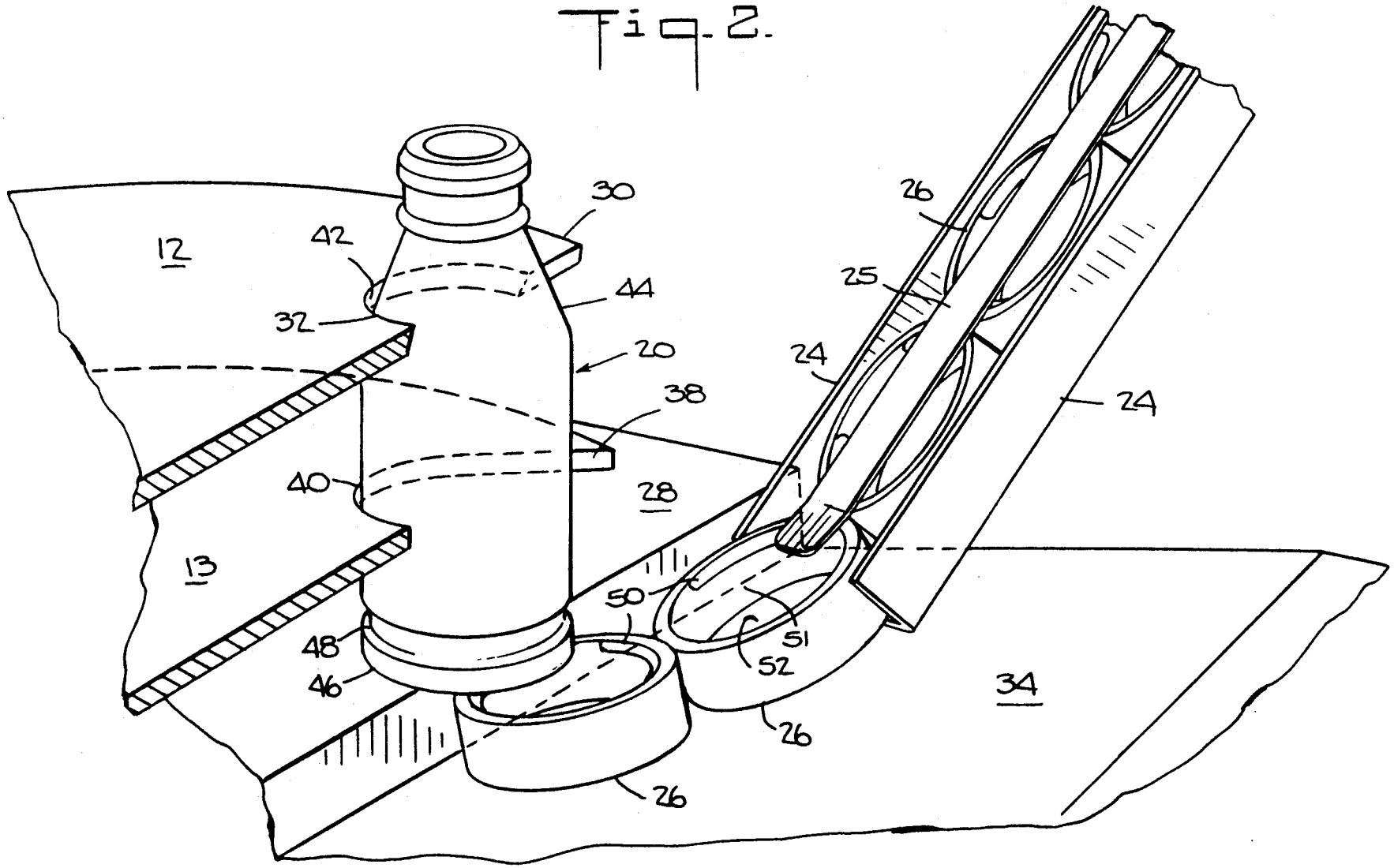
FIG. 2 is an enlarged, partial, perspective view showing a portion of the elements depicted in FIG. 1 and particularly illustrating a receptacle, a supply of bail supporting cap members, and a cap member positioned below the receptacle prior to alignment of the receptacle and the cap member.

Turning now to FIG. 2, location B is shown therein in greater detail. Specifically, there is illustrated receptacle 20, a supply of bail supporting cap members 26 and a cap member positioned on surface 34 below receptacle 20, sitting on surface 28, prior to alignment of the receptacle and the cap member. Also shown in this view, in greater detail, are platform 13 which, like platform 12, rotates about spindle 14, pocket 38 disposed in platform 13 and contacting outer wall 40 of receptacle 20, and beveled surface 42 of pocket 32 which contacts shoulder portion 44 of the receptacle. The primary function of pocket 38 in platform 13 is to substantially maintain receptacle 20 in a predetermined orientation. Here the orientation is substantially vertical and substantially perpendicular to substantially horizontal surface 28. It should here be understood that the bail applicator can also be functional without rotating platform 13 but, that in the preferred embodiment, platform 13 is included. As will be shown in greater detail in subsequent views, beveled surface 42 of pocket 32, upon bearing against shoulder 44 of receptacle 20, functions to limit movement of the receptacle. Here movement is restricted upwardly in the vertical direction. Further shown are bottom edge 46 and recess 48 of receptacle 20 and projecting segment 50, inner surface 51 and bottom wall 52 of end cap member 26. The next two drawing figures will better illustrate the bail applicator and its function.

Figure 3:
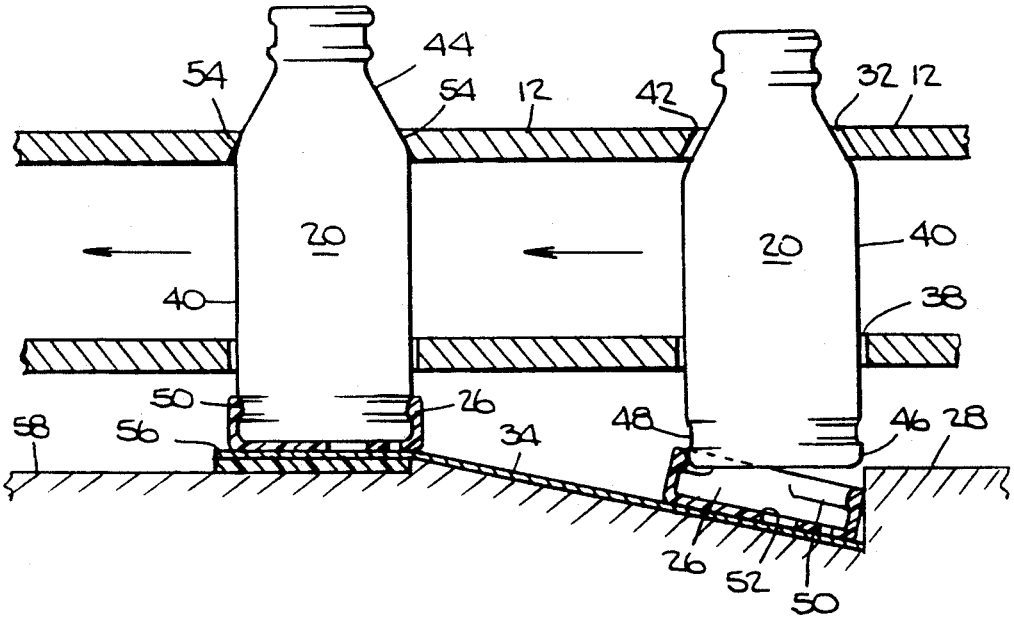
FIG. 3 is a sectional view taken along line 3—3 of the applicator shown in FIG. 1 and showing a first receptacle with a cap member snugly placed thereon and a second receptacle and cap member in alignment prior to coupling.

Now turning to FIG. 3, there is shown a line of sight taken along line 3—3 of FIG. 1 looking in the direction indicated by the arrows. The rightmost receptacle, no longer in contact with surface 28, is in contact with and positioned for receipt within cap member 26. Pockets 32 and 38 will control the movement of the receptacle in the horizontal direction indicated by the arrows. The rightmost receptacle will be moved to the leftmost position by rotation of platforms 12 and 13. The receptacle and cap member will together move from right to left up surface 34 to the leftmost position shown where vertical movement of the receptacle will be limited by the bearing of beveled surface 42 of pocket 32 on shoulder 44 as shown at location designation 54. Projecting segment 50 of end cap member 26 will slide over bottom edge 46 of receptacle 20 and snap fit into recess 48. The maximum force exerted on the receptacle and cap member to press the receptacle and the cap member into snug engagement is generated when the combination is on surface 56 at the leftmost position in this view. Thereafter, the coupled receptacle and cap member is further advanced to a location on surface 58 (FIG. 4) wherein beveled surface 42 is no longer exerting a force against shoulder 44. The combination is then still further moved along to location C (FIG. 1) wherein it is released from the rotating platforms and guided for exit from the system at location D (FIG. 1).

Figure 4:
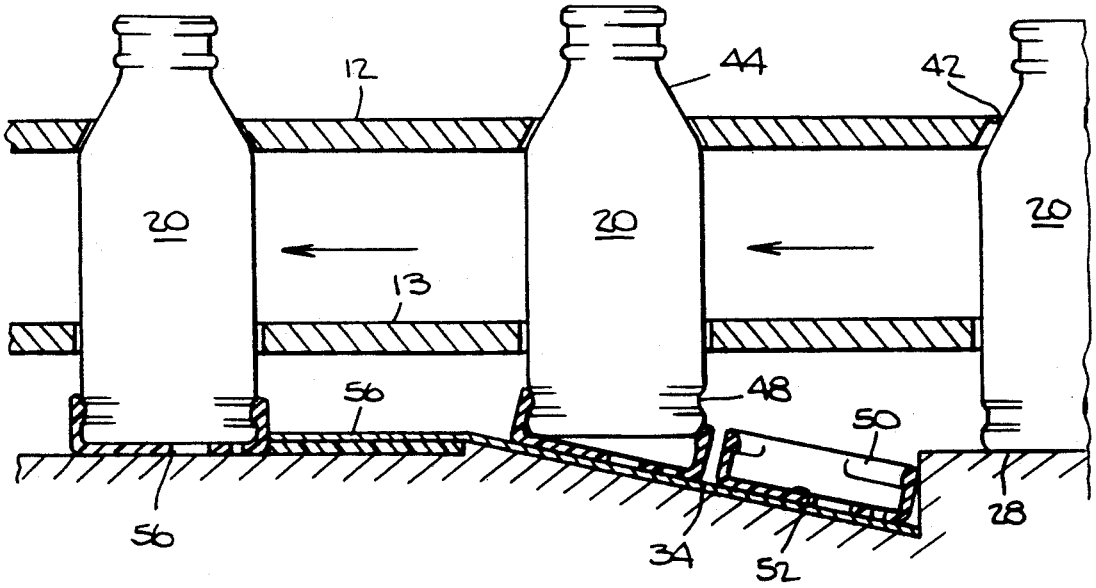
FIG. 4 is a view like that depicted in FIG. 3 and showing the first receptacle in another position, the second receptacle in alignment just prior to placement of the cap thereon, and a third receptacle and cap member positioned to begin the coupling sequence anew.

FIG. 4 is a view much like that of FIG. 3. Therein shown on surface 58 is a capped receptacle at the leftmost location. A receptacle and end cap member is shown at the middle location being moved up the ramp surface 34 for receptacle and cap coupling. A third receptacle on surface 28 at the rightmost location is shown being moved forward for positioning to engage a cap member resting on the sloping surface 34.

FIG. 5 illustrates a partial, inverted view of receptacle 20 with end cap member 26 securely attached thereto. Also shown in this view, is flexible bail member 60 disposed in bottom wall 52 of the end cap member. FIG. 6 illustrates the coupled receptacle and bail supporting end cap member in a typical use position. In this view, bail 60 has been rotated to the position shown and is hung over a curved end of support pole 62 wherein fluid is delivered from receptacle 20 to patient P via tubing 64.

The device of the present invention in the preferred embodiment automatically applies and secures bails to receptacles. Using a starwheel, each receptacle is controlled and moved along a circular path. The cap members, each with at least one bail, are fed into the device. Each cap member is picked up by the leading bottom edge of a receptacle and moved up a ramp surface and securely pressed onto the bottom of the receptacle. The vertical force necessary for seating the cap member and bail onto the base of the receptacle is imparted by a tapered pocket of the top section of the starwheel which bears on the shoulder of the receptacle. The receptacle with attached cap member and bail is subsequently discharged from the device.

The present invention has been described herein with specific reference to the preferred embodiments thereof. However, those skilled in the art will understand that changes may be made in the form of the invention covered by the claims without departing from the scope and spirit thereof, and that certain features of the invention may sometimes be used to an advantage without corresponding use of the other features.

We claim:

1. An apparatus for applying an end cap member to a receptacle comprising means for moving said receptacle from a first position to a second position in a first plane, a first surface located intermediate said first and second positions defining a second plane having a first portion stepped away from said first plane, with said second plane extending from said stepped first portion sloping toward said first plane generally in the direction of receptacle movement, laterally positioned means for supplying said cap member into said first portion, with said cap member being configured for receiving an end of said receptacle, means for aligning said receptacle and said cap member, with said receptacle being positioned for receipt within said cap member, and means for moving an aligned receptacle and cap member combination along said first surface, said means for moving the receptacle and cap member combination being a structure having first and second receptacle contacting faces with one of said first and second receptacle contacting faces coacting with said sloping first surface to generate compressive force between said receptacle and said cap member as said receptacle and cap member combination advances from said first portion and along said first surface thereby urging said cap member and said receptacle snugly into engagement.

2. The apparatus according to claim 1 wherein said cap member is generally of cup-shaped configuration comprising a bottom wall and a side wall having an inner surface with means for engaging complementary means disposed on said receptacle.

3. The apparatus according to claim 2 wherein aid cap member further supports a bail member.

4. The apparatus according to claim 1 further including means for capturing and for substantially maintaining said receptacle in a predetermined orientation.

5. The apparatus according to claim 1 wherein said last named means includes a second surface contacting said receptacle and substantially restraining said receptacle against movement in a plane substantially perpendicular to said first plane.

6. An apparatus for applying an end cap member to a receptacle comprising a first surface having a first slope, means for advancing said receptacle along said first surface, a second surface having a second slope, with said second surface being stepped away from said first surface at a first location along said first surface and with said second surface sloping from said first location in the direction traveled by the advancing receptacle, laterally positioned means for supplying said cap members onto said second surface proximate said first location, with said cap member being configured to receive therein an end of said receptacle, and means for advancing a combination receptacle, aligned for receipt within said cap member, and cap member along said second surface, said means for advancing the receptacle and cap member combination being a structure comprising first and second platforms engaging said receptacle, with one of said platforms coacting with said second surface to develop compressive force between said receptacle and said cap member as said receptacle and cap member combination advances from said first location and along said second surface thereby pressing said cap member snugly onto said receptacle.

7. The apparatus according to claim 6 wherein said first slope is substantially horizontal.

8. The apparatus according to claim 6 further including means for capturing and for maintaining said receptacle in substantially a vertical orientation.

9. The apparatus according to claim 6 wherein said cap member is generally of cup-shaped configuration comprising a bottom wall and a side wall having an inner surface with means for engaging complementary means disposed on said receptacle.

10. The apparatus according to claim 9 wherein said cap member includes a flexible bail member formed in said bottom wall.

11. The apparatus according to claim 6 wherein one of said platforms substantially restrains said receptacle against movement in a plane substantially perpendicular to said first surface.

12. The apparatus according to claim 11 wherein aid one of said platforms includes a beveled surface contacting a shoulder portion of said receptacle.

13. A method of applying an end cap member to a receptacle comprising the steps of:

supplying a receptacle at a first location, advancing said receptacle along a first surface to a second location, at said second location, supplying a cap member, being configured to receive therein an end of said receptacle, from a laterally positioned means into a portion of a second surface stepped away from said first surface, said second surface extending toward said first surface and sloping in the direction of receptacle advancement from said stepped portion, said second surface defining a passive inclined plane, aligning said receptacle and said cap member, positioning said receptacle for receipt within said cap member, and advancing along said second surface a combination aligned receptacle and cap member by contacting said receptacle with at least two receptacle contacting surfaces and developing a compressive force between said receptacle and said cap member by coacting one of said contacting surfaces and said sloped second surface as said receptacle and cap member combination advances along said second surface thereby pressing the receptacle and the cap member into snug engagement.

14. The method according to claim 13 wherein said cap member is generally cup-shaped configuration comprising a bottom wall and a side wall having an inner surface with means for engaging complementary means disposed on said receptacle.

15. The method according to claim 14 wherein said cap member includes a flexible bail member formed in said bottom wall.

* * * * *